US010279494B2

(12) United States Patent
Uno et al.

(10) Patent No.: US 10,279,494 B2
(45) Date of Patent: May 7, 2019

(54) CUTTING APPARATUS AND CUTTING METHOD

(71) Applicant: UNO SEISAKUSHO CO., LTD., Kanagawa (JP)

(72) Inventors: Tadao Uno, Kanagawa (JP); Yosuke Uno, Kanagawa (JP)

(73) Assignee: UNO SEISAKUSHO CO.,LTD., Kanagawa (JP)

( * ) Notice: Subject to any disclaimer, the term of this patent is extended or adjusted under 35 U.S.C. 154(b) by 15 days.

(21) Appl. No.: 15/319,268

(22) PCT Filed: Jun. 18, 2014

(86) PCT No.: PCT/JP2014/066173
§ 371 (c)(1),
(2) Date: Dec. 15, 2016

(87) PCT Pub. No.: WO2015/193993
PCT Pub. Date: Dec. 23, 2015

(65) Prior Publication Data

US 2017/0151685 A1 Jun. 1, 2017

(51) Int. Cl.
*B26D 5/00* (2006.01)
*B27B 5/00* (2006.01)
(Continued)

(52) U.S. Cl.
CPC ..... *B26D 1/09* (2013.01); *B26D 1/08* (2013.01); *B26D 7/01* (2013.01); *B26D 7/015* (2013.01);
(Continued)

(58) Field of Classification Search
CPC ..... B26D 1/09; B26D 7/015; B26D 7/0675; B26D 11/00; B26D 1/08; B26D 7/01; B26D 7/06; B65H 2301/42262; B65H 2301/4229
(Continued)

(56) References Cited

U.S. PATENT DOCUMENTS 4,045,944 A * 9/1977 Giori ..... B65H 29/62 198/447
4,283,902 A * 8/1981 Giori ..... B26D 7/0675 53/399
(Continued)

FOREIGN PATENT DOCUMENTS

JP 53-91899 8/1978
JP 5-169396 A 7/1993
(Continued)

*Primary Examiner* — Ghassem Alie
*Assistant Examiner* — Bharat C Patel
(74) *Attorney, Agent, or Firm* — Muncy, Geissler, Olds & Lowe, P.C.

(57) ABSTRACT

A cutting apparatus including a first pusher for pushing and conveying the left side, toward the right side direction; a second cutter for cutting the right side of the large sheet block and sequentially cutting the right end to divide the sheet into long column unit blocks in the up-and-down direction; a right side remover for removing the remaining portion; a column unit block conveyer for conveying the column unit blocks in the right side direction while maintaining a predetermined interval thereamong; a second pusher for pushing and conveying the upper sides of the cut column unit blocks toward the lower side direction; a fourth cutter for cutting the lower side of the column unit block and sequentially cutting the lower end of the column unit block into small blocks; and a lower side remover for removing the remaining portion.

16 Claims, 15 Drawing Sheets

(51) Int. Cl.

| | |
|---|---|
| ***B26D 1/09*** | (2006.01) |
| ***B26D 1/08*** | (2006.01) |
| ***B26D 7/01*** | (2006.01) |
| ***B26D 7/06*** | (2006.01) |
| ***B26D 11/00*** | (2006.01) |

(52) U.S. Cl.
CPC ..... *B26D 7/06* (2013.01); *B26D 7/0675* (2013.01); *B26D 11/00* (2013.01); *B65H 2301/4229* (2013.01); *B65H 2301/42262* (2013.01)

(58) Field of Classification Search
USPC ..... 83/404.1
See application file for complete search history.

(56) References Cited

U.S. PATENT DOCUMENTS 4,505,173 A * 3/1985 Hartlage ..... B26D 1/09 83/104
4,710,089 A * 12/1987 Schneider ..... B65G 59/08 221/227
5,235,883 A * 8/1993 Jeske ..... B07C 5/36 271/303
5,311,801 A * 5/1994 Uno ..... B26D 7/0675 83/276
5,365,817 A * 11/1994 Maeda ..... B26D 7/015 271/240
5,507,615 A * 4/1996 Uno ..... B65G 57/035 198/431
7,975,583 B2 * 7/2011 Schmid ..... B26D 5/34 83/241
8,382,089 B2 * 2/2013 Yonekawa ..... B26D 7/015 270/21.1

FOREIGN PATENT DOCUMENTS

| | | | |
|---|---|---|---|
| JP | 7-102518 | B2 | 11/1995 |
| JP | 9-300292 | A | 11/1997 |
| JP | 10-171963 | A | 6/1998 |
| JP | 2002-239974 | A | 8/2002 |
| JP | 2003-519017 | A | 6/2003 |
| JP | 2003175491 | A | 6/2003 |
| JP | 2007-304454 | A | 11/2007 |
| JP | 2008-200804 | A | 9/2008 |
| JP | 2010-207966 | A | 9/2010 |

* cited by examiner (a)

(b)

CUTTING APPARATUS AND CUTTING METHOD

BACKGROUND OF THE INVENTION

Field of the Invention

The present invention relates to a cutting apparatus and a method for cutting a large sheet block obtained by stacking a plurality of large sheets into finally provide small blocks such as paper money or postcards. In particular, the invention relates to a technique for realizing a highly accurate finishing.

Description of the Related Art

Patent Literature 1 discloses a step of placing a sheet obtained by arranging and printing many paper monies to strap this placed sheet while cutting the sheet into small blocks. An apparatus by the practical realization of this invention uses a method of using one pusher to intermittently send the placed sheet into a cutting means to divide the sheet into small blocks, i.e., a method of using the one pusher to send the placed sheet into the cutting means until the division of the placed sheet is completed.

This publication includes a primary division step to firstly divide the placed sheet on the basis of a column unit and a secondary division step to further divide, on the basis of a printing unit, the placed sheet divided on the basis of a column unit. In the above conventional example, one pusher is used to feed sheets into the cutting means until the division of one placed sheet is completed in any of a step of dividing the sheet based on the column unit and a step of dividing the sheet based on the printing unit.

However, in the case of such a conventional technique, after the feeding of the placed sheet into the cutting means by the pusher is completed, the subsequent feeding of the placed sheet cannot be started immediately. Specifically, at least during the period in which the pusher returns from the position at which the feeding of one placed sheet is completed (cutting-completed position) to the position at which the feeding is started, the subsequent feeding of the placed sheet is stopped, causing a significant loss in the feeding operation. This feeding loss is accumulated for each placed sheet. This accumulated loss disadvantageously causes a significant decrease in the operating efficiency of the cutting apparatus, causing a remarkable decrease in the processing capability of the entire line including the cutting apparatus.

Patent Literature 2 is an invention by the applicant of this application to solve the problem of the conventional technique. Specifically, this invention provides a cutting apparatus that can divide a placed sheet into small blocks with a high efficiency.

Specifically, a cutting apparatus including a conveyance rail for supporting the lower face of a placed sheet to guide the conveyance and a cutting means for dividing the placed sheet supported and supplied by the conveyance rail into a plurality of small blocks is configured to include the first pusher for intermittently feeding the placed sheet to the cutting means until the halfway of the placed sheet to supply the sheet to the primary division and the second pusher for carrying on the operation of the first pusher to intermittently feed the remaining placed sheet subjected to the primary division to the cutting means. The first pusher and the second pusher are arranged to return to the respective feed start positions while the first pusher and the second pusher are respectively performing the intermittent feeding so that the next intermittent feeding can be started.

According to the invention of Patent Literature 2, the first pusher can immediately start the subsequent feeding of the placed sheet prior to the completion of the sheet feeding by the second pusher. This can securely solve the operation loss in the conventional example caused by the pusher returning from a position at which the preceding feeding of the placed sheet is completed to a position at which the subsequent feeding of the placed sheet is started. Furthermore, the repetition of the alternate feeding operations by the first and second pushers for each placed sheet can effectively solve the accumulated loss to significantly improve the operation efficiency of the cutting apparatus, thus allowing the entire line including the cutting apparatus to have a remarkably-improved processing capability.

The invention of Patent Literature 3 suggests a method for cutting a not-printed strip while rotating stacked sheets. Specifically, the method has the following respective steps. In order to cut the first not-printed strip of the stacked sheets, the stacked sheets is conveyed to the lower side of a blade and the first strip is cut. Then, the stacked sheets are conveyed and the first rotation is performed. Then, in order to cut the second not-printed strip, the second not-printed strip is guided again to the lower side of the blade and the second strip is cut. A stacked body is then conveyed to cause the second rotation to be performed. Then, in order to cut the third not-printed strip, the third not-printed strip is guided again to the lower side of the blade to cut the third strip and continuous superimposed strips of valuable securities. Then, the continuous superimposed strips of valuable securities are cut to provide individual valuable securities.

CITATION LIST

Patent Literature

Patent Literature 1: U.S. Pat. No. 4,045,944

Patent Literature 2: Japanese Examined Patent Application No. H07-102518

Patent Literature 3: Japanese Unexamined Patent Application Publication No. 2003-519017

Patent Literature 4: Japanese Unexamined Patent Application No. H09-300292

Patent Literature 5: Japanese Unexamined Patent Application No. H10-171963

The technique of Patent Literature 3 has a purpose of reducing the number of operations required to process stacked valuable security sheets into individual stacked bodies of valuable securities. However, this technique requires stacked sheets to be cut three times while being rotated three times, thus failing to improve the complexity of the operation itself. Furthermore, repeated cutting and rotating operations disadvantageously cause the friction among the stacked sheets so that a highly accurate cutting cannot be performed.

On the other hand, in the case of conventional cutting apparatus and cutting method, the improvement of the cutting accuracy disadvantageously requires a decrease in the processing capability. Thus, the above conventional technique also has not yet provided a technique to improve the operation efficiency more than in the conventional case.

BRIEF SUMMARY OF THE INVENTION

The present invention has been made in view of the problem of the conventional technique as described above. It is an objective of the invention to provide a cutting apparatus and a method for cutting small blocks such as paper monies or postcards out of a large sheet by which the manufactured small blocks can have an improved cutting accuracy and steps can be simplified and the cutting equipment can have a smaller scale simultaneously.

In order to solve the problem as described above, the present invention provides a cutting apparatus and a cutting method as described below.

The invention provides a cutting apparatus by which a large sheet block obtained by stacking a plurality of large sheets is cut by a cutting means to divide the block into small blocks.

The respective sides when the large sheet is seen from above are assumed as an upper side, a right side, a lower side, and a left side, respectively. Two adjacent reference sides that have been jogged are assumed as an upper side and a left side and are placed in the cutting apparatus. The cutting apparatus includes a first pusher for pushing and conveying the left side of the cut large sheet block toward the right side direction; a second cutting means for cutting the right side of the large sheet block pushed and conveyed by the first pusher and sequentially cutting the right end of the large sheet block while interacting with the pushing and conveyance by the first pusher to divide the block into long column unit blocks in the up-and-down direction; and a right side removal means for removing the remaining portion after the right side cutting by the second cutting means is removed.

Furthermore, a cutting apparatus is provided characterized in including: a column unit block conveyance means for conveying the column unit blocks formed by the cutting in the right side direction while maintaining a predetermined interval thereamong; a second pusher for pushing and conveying the upper sides of the cut column unit blocks toward the lower side direction; a fourth cutting means for cutting the lower side of the column unit block pushed and conveyed by the second pusher and sequentially cutting the lower end of the column unit block while interacting with the pushing and conveyance by the second pusher to divide the block into small blocks; and a lower side removal means for removing the remaining portion after the lower side cutting by the fourth cutting means.

As described, another configuration may be used in which the second cutting means cuts the left side of a final column unit block sequentially cut out of the large sheet block and a left side removal means for removing a remaining portion after the left side cutting is provided.

As described, another configuration may be used in which the fourth cutting means cuts the upper side of the final small block sequentially cut out of the column unit block and an upper side removal means for removing a remaining portion after the upper side cutting is provided.

The invention provides a cutting apparatus by which a large sheet block obtained by stacking a plurality of large sheets is cut by a cutting means to divide the block into small blocks, when the large sheet is seen from above are assumed as an upper side, a right side, a lower side, and a left side, respectively, comprising: a first cutting means for cutting a left side of the large sheet block; a first pusher for pushing and conveying the left side of the cut large sheet block toward the right side direction; a second cutting means for cutting the right side of the large sheet block pushed and conveyed by the first pusher and sequentially cutting the right end of the large sheet block while interacting with the pushing and conveyance by the first pusher to divide the block into long column unit blocks in the up-and-down direction; and a right side removal means for removing the remaining portion after the right side cutting by the second cutting means.

The invention is characterized in comprising: a column unit block conveyance means for conveying the column unit blocks formed by the cutting in the right side direction while maintaining a predetermined interval thereamong; a third cutting means for cutting each upper side of the column unit block; a second pusher for pushing and conveying the upper sides of the cut column unit blocks toward the lower side direction; a fourth cutting means for cutting the lower side of the column unit block pushed and conveyed by the second pusher and sequentially cutting the lower end of the column unit block into small blocks while interacting with the pushing conveyance by the second pusher; and a lower side removal means for removing the remaining portion after the lower side cutting by the fourth cutting means.

According to the invention, the first cutting means and the second cutting means are configured to use a single edge-shaped blade edge of which one side is substantially vertical and the other side has an inclined blade ridge. The blade edge of the first cutting means can be placed so that the left side of a cut large sheet block faces the substantially vertical side. The blade edge of the second cutting means can be placed so that the left side of a cut column unit block faces the blade ridge.

According to the invention, the third cutting means is configured to use a single edge-shaped blade edge of which one side is substantially vertical and the other side has an inclined blade ridge. The blade edge of the third cutting means can be arranged so that the upper side of a cut column unit block faces the substantially vertical side.

According to the invention, any one of the first pusher or the second pusher includes a main pusher performing the pushing and conveyance from a feed start position to a midway position and a following pusher taking over the operation at a midway position from the main pusher to push and convey the same side and is placed so that one pusher returns to a feed start position while the other pusher is performing an intermittent feeding so as to be able to immediately start the next intermittent feeding.

As described above, the cutting apparatus also can include a small block conveyance means for conveying the small blocks divided by the fourth cutting means in the right side direction while maintaining a predetermined interval thereamong and a strapping means for strapping the respective small blocks.

As described above, another configuration may be used in which the cutting is performed while directions parallel to the right side and the left side of the large sheet block conform to the paper grain direction.

According to the invention, the right side removal means includes a butterfly mechanism that releases, immediately behind in the conveyance direction of the second cutting means, the remaining portion after the right side cutting in the upper or lower direction only when the remaining portion is dropped and that is normally horizontally closed, providing a configuration to control the opening and closing in accordance with the pushing and conveyance by the first pusher.

According to the invention, the lower side removal means includes a butterfly mechanism that releases, immediately behind in the conveyance direction of the fourth cutting means, the remaining portion after the lower side cutting in the upper or lower direction only when the remaining portion is dropped and that is normally horizontally closed, providing a configuration to control the opening and closing in accordance with the pushing and conveyance by the second pusher.

According to the invention, in the cutting apparatus according to any of claims 1 to 11, the right side and the right end in the above description and the left side and the left end can be mutually exchanged to provide a symmetrical configuration.

The invention can provide a cutting method by which a large sheet block obtained by stacking a plurality of large sheets is cut by a cutting means to divide the sheet into small blocks.

The respective sides when the large sheet is seen from above are assumed as an upper side, a right side, a lower side, and a left side, respectively. Two adjacent reference sides that have been jogged are assumed as an upper side and a left side and are placed in the cutting apparatus. The method is characterized in having the following respective steps. Specifically:

(a) a first push step to allow the first pusher to push and convey the left side of the cut large sheet block toward the right side direction;

(b) a right side cutting step to allow, after the first push step, the second cutting means to cut the right side of the large sheet block;

(c) a right side removal step to allow the right side removal means to remove the remaining portion after the right side cutting;

(d) a column unit division step to allow the second cutting means to sequentially cut, while interacting with the pushing and conveyance by the first pusher, the right end of the large sheet block to divide the block into long column unit blocks in the up-and-down direction;

(e) a column unit block conveyance step to allow the column unit block conveyance means to convey the column unit blocks in the right side direction while maintaining a predetermined interval thereamong;

(f) a second push step to allow the second pusher to push and convey the upper side of the column unit block toward the lower side direction;

(g) a lower side cutting step to allow the fourth cutting means to cut the lower side of the column unit block after the second push step;

(h) a lower side removal step to allow a lower side removal means to remove a remaining portion after the lower side cutting; and (i) a small block division step to allow the fourth cutting means to sequentially cut, while interacting with the pushing and conveyance by the second pusher, the lower end of the column unit block to divide the block into small blocks.

The invention has a configuration in which the second cutting means cuts the left side of a final column unit block sequentially cut out of the large sheet block and further has, after (e) column unit division step, (e-2) left side removal step to allow the left side removal means to remove a remaining portion after the left side cutting.

The invention has a configuration in which the fourth cutting means cuts the upper side of the final small block sequentially cut out of the column unit block and further has, after (i) small block division step, (i-2) upper side removal step to allow the upper side removal means to remove a remaining portion after the upper side cutting.

The invention provides a cutting method by which a large sheet block obtained by stacking a plurality of large sheets is cut by a cutting means to divide the sheet into small blocks. The respective sides when the large sheet is seen from above are assumed as an upper side, a right side, a lower side, and a left side, respectively. The method is characterized in having the following steps. Specifically:

(A) a first cutting step to allow a first cutting means to cut the left side of the large sheet block;

(B) a first push step to allow the first pusher to push and convey the left side of the cut large sheet block toward the right side direction;

(C) a right side cutting step to allow, after the first push step, the second cutting means to cut the right side of the large sheet block;

(D) a right side removal step to allow the right side removal means to remove the remaining portion after the right side cutting;

(E) a column unit division step to allow the second cutting means to sequentially cut, while interacting with the pushing and conveyance by the first pusher, the right end of the large sheet block to divide the block into long column unit blocks in the up-and-down direction;

(F) a column unit block conveyance step to allow the column unit block conveyance means to convey the column unit blocks in the right side direction while maintaining a predetermined interval thereamong;

(G) a third cutting step to allow the third cutting means to cut each upper side of the column unit block;

(H) a second push step to allow the second pusher to push and convey the upper sides of the cut column unit blocks toward the lower side direction;

(I) a lower side cutting step to allow the fourth cutting means to cut the lower side of the column unit block after the second push step;

(J) a lower side removal step to allow a lower side removal means to remove a remaining portion after the lower side cutting; and (K) a small block division step to allow the fourth cutting means to sequentially cut, while interacting with the pushing and conveyance by the second pusher, the lower end of the column unit block to divide the block into small blocks.

According to the invention, in the above cutting method, a single edge-shaped blade edge of which one side is substantially vertical and the other side has an inclined blade ridge is used as the cutting means. A side pushed and conveyed by the pusher in each push step can be cut by a substantially vertical-side blade edge.

The invention according to can further have, in the above cutting method, a small block conveyance step to convey, after the small block division step, the small blocks in the right side direction while maintaining a predetermined interval thereamong and a strapping step to strap the respective small blocks.

According to the invention, the cutting can be performed while directions parallel to the right side and the left side of the large sheet block conform to the paper grain direction.

According to the invention, in the cutting method, the right side and the right end and the left side and the left end can be mutually exchanged in the above description to provide a symmetrical configuration.

When the large sheet is cut into small blocks such as paper money or postcards, manufactured small blocks can be cut with a higher accuracy, and can realize simplification of the steps and the cutting equipment having a smaller scale simultaneously.

DETAILED DESCRIPTION OF THE INVENTION

Figure 1:
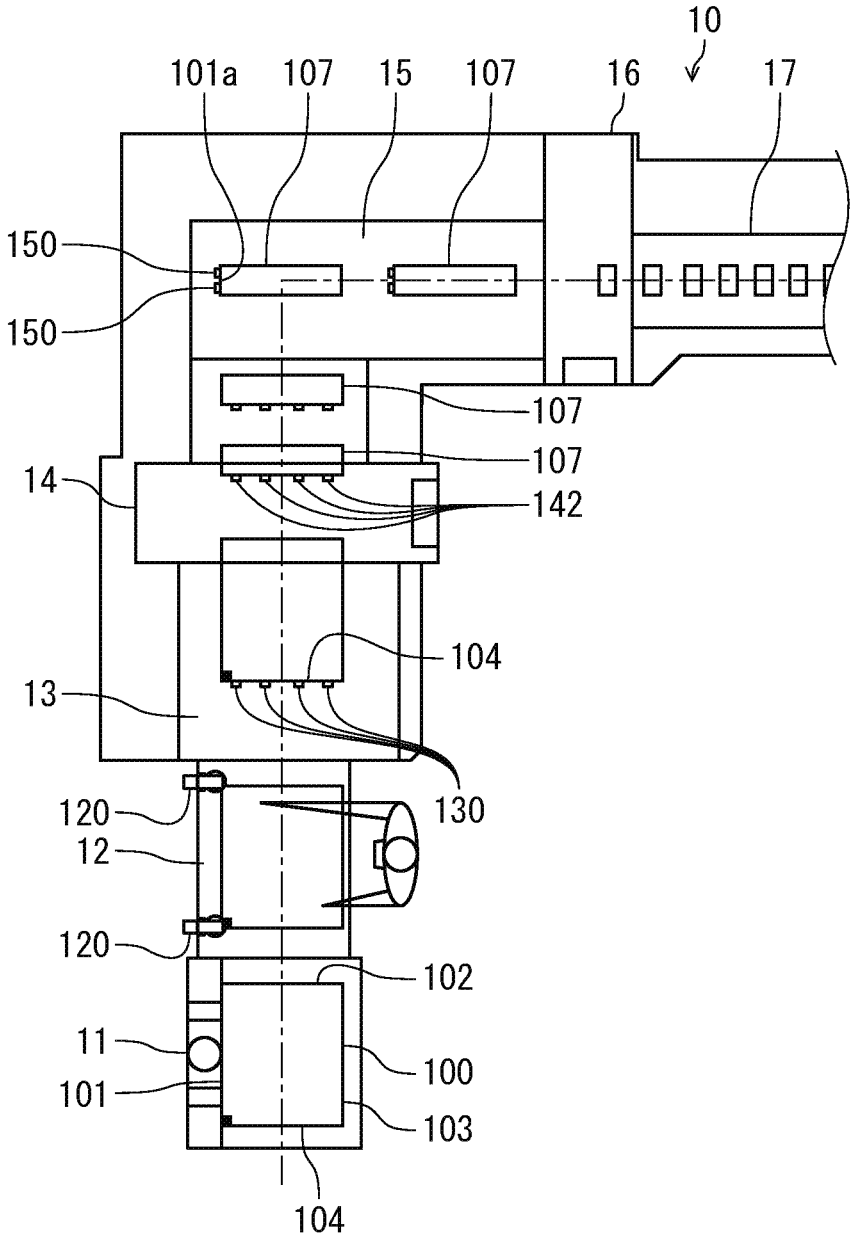
FIG. 1 is an illustration diagram illustrating the entirety of a cutting apparatus according to the first illustrative embodiment of the present invention.

The following section will describe an illustrative embodiment of the present invention based on an embodiment shown in the drawings. The embodiment is not limited to the following one.

(First Illustrative Embodiment)

FIG. 1 is an illustration diagram illustrating the entirety of a cutting apparatus 10 according to the first illustrative embodiment of the present invention. The present invention is an apparatus to cut small blocks having a relatively-small paper size such as paper money, lottery, postcards, or valuable securities out of 100 large sheet blocks as a unit for example. The present invention is not limited to them but is suitable for cutting apparatuses requiring a cut paper having a size of a high accuracy.

The cutting apparatus 10 includes, in an order of steps, a jogging machine 11 of a large sheet 100, a counting machine 12, the first conveyance machine 13, the second cutting machine 14, the second conveyance machine 15, the fourth cutting machine 16, and a discharge machine 17.

In this illustrative embodiment, first, reference sides of the large sheet 100 are aligned in the jogging machine 11. The configuration of the jogging machine 11 is known and thus the illustration thereof is omitted. For example, as disclosed in Patent Literature 4, a gripper draws a placed block by a predetermined amount to jog the front end face of the placed block to a front stopper to release the clamp of the placed block. In this state, the back jogging is raised by a fluid pressure cylinder from below to a position opposed to the back end face of the placed block. Then, in the back jogging, the cylinder is used to jog the back end face of the placed block to the front stopper to thereby jog the front end face of the placed block to the front stopper.

Figure 2:
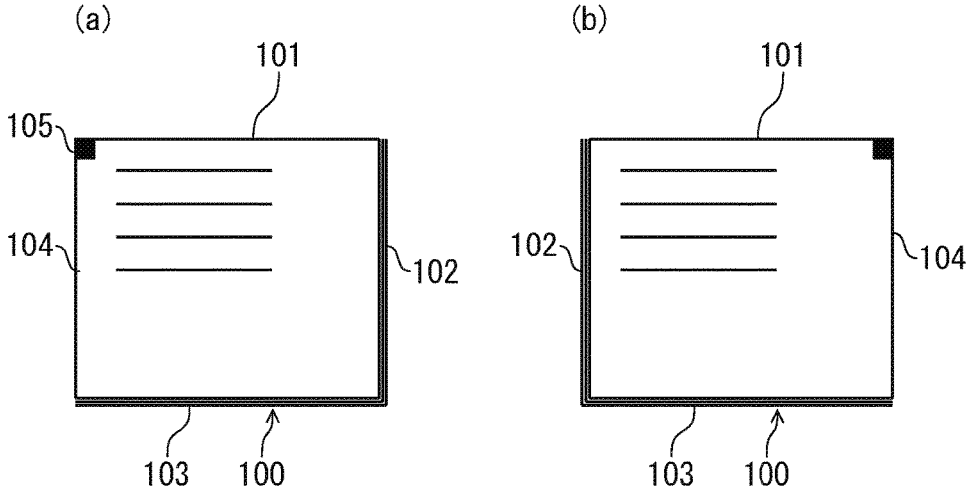
FIG. 2 is an illustration diagram illustrating the reference side in a large sheet.

FIG. 2 is an illustration diagram illustrating the reference side in the large sheet 100. When the large sheet 100 is seen from above, the respective sides are assumed as the upper side 101, the right side 102, the lower side 103, and the left side 104, respectively. As shown in FIG. 2(*a*), the jogging machine 11 jogs the upper side 101 and the left side 104 as a reference side. In the present invention, a jogged side is called as a reference side and an angle sandwiched between two reference sides is called as a reference angle 105. Since a large sheet has an erroneous length depending on the distortion during manufacture or printing, failing to provide aligned opposite sides to the reference sides.

On the other hand, in the case of the present invention, the inclusion of the jogging machine 11 is not always required. Specifically, a block obtained by jogging a large sheet in advance also can be used. In this case, the block may be set in the cutting apparatus 10 so that two adjacent reference sides that have been jogged are set as an upper side and a left side.

When the jogging machine 11 is not used and the large sheet block 100 jogged in advance is used, there may be a case as shown in FIG. 2(*b*) in which, when the large sheet block is seen with the printing face facing upward, the upper side and the right side becomes the reference side when the large sheet block is seen. In this case, the front and back sides of the large sheet block 100 can be inverted to set the upper side and the left side as the reference side and the block 100 can be subsequently set in the cutting apparatus 10.

In the jogging machine 11, the jogged large sheet block 100 is gripped by the gripper and is accurately counted by the counting machine 12. The counting machine 12 includes a counter 120. The counter 120 can be a rotation-type sheet counting machine disk as disclosed in Patent Literature 5.

Figure 3:
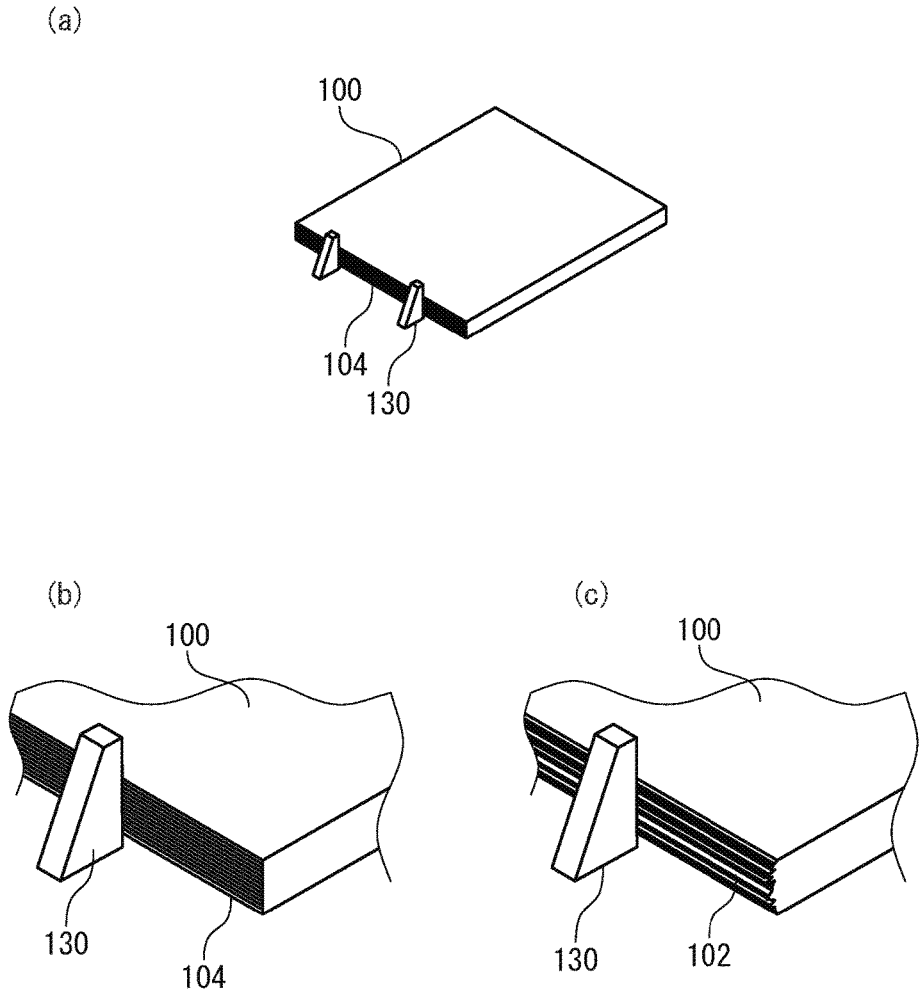
FIG. 3 is an illustration diagram illustrating a push means according to the present invention.
Figure 4:
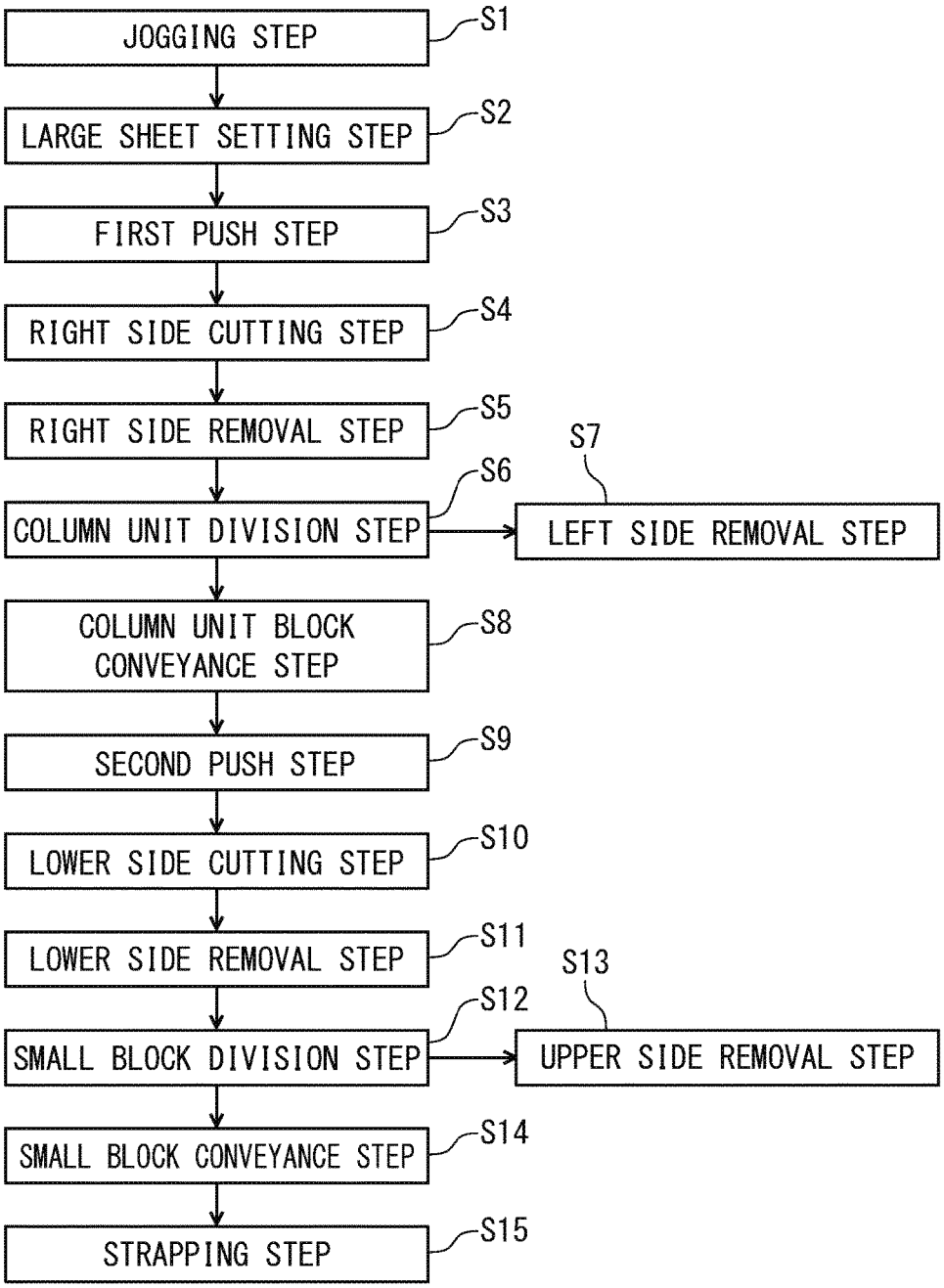
FIG. 4 is a flowchart illustrating the cutting method according to the first illustrative embodiment of the present invention.

Through the above preparation steps, the processing proceeds to the cutting processing of the present invention. FIG. 3 is an illustration diagram illustrating a push means according to the present invention. FIG. 4 is a flowchart illustrating the cutting method according to the first illustrative embodiment. In FIG. 4, a jogging step S1 is as described above. Next, the large sheet is set in the first conveyance machine 13 (S2).

(a) First Push Step S3

The first conveyance machine 13 pushes and conveys the left side of the cut large sheet block toward the right side direction. The first conveyance machine 13 includes four first pushers 130 for example. The first pusher 130 pushes and conveys the left side 104 of the large sheet block as shown in FIG. 3(*a*).

When the jogged left side 104 is pushed by the first pusher 130 as shown in FIG. 3(*b*), substantially no displacement is caused in the large sheet 100. When a not-jogged side (e.g., the right side 102) is pushed by the first pusher 130 as shown in FIG. 3(*c*) on the other hand, each sheet is undesirably displaced due in accordance with a not-aligned end.

In the case of the conventional cutting machine, no consideration has been paid to that point that the respective sides are cut and the sheet is subsequently rotated (Patent Literature 3) or that a side is pushed by the pusher (Patent Literature 2), causing a problem of a lowered cutting accuracy. The present invention on the other hand contributes to an accurate cutting processing by pushing the reference side.

Figure 5:
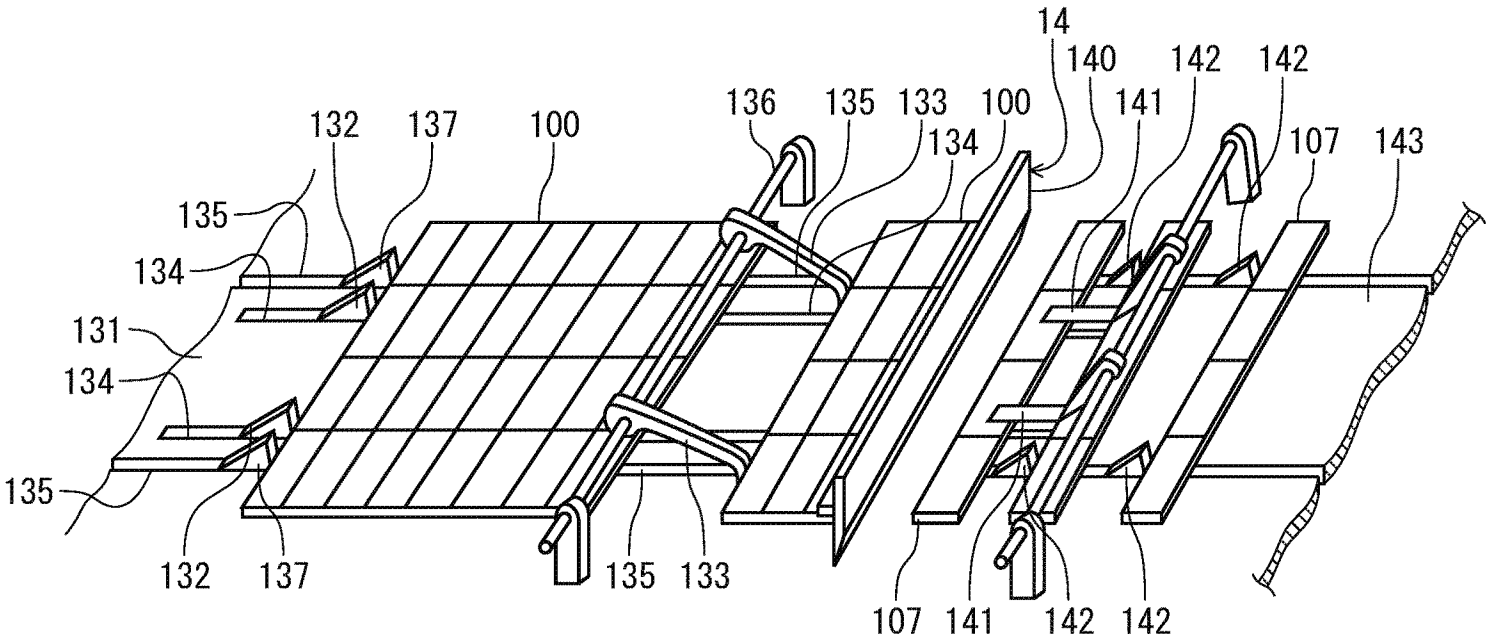
FIG. 5 is a perspective view illustrating a part of the cutting apparatus according to the first illustrative embodiment of the present invention.

The following section will describe a specific configuration of the first conveyance machine 13. As shown in a perspective view of FIG. 5, a main pusher 132 and a following pusher 133 constituting the first pusher 130 are provided along a conveyance rail 131 in a reciprocatable manner. For example, the main pusher 132 is provided at the lower face side of the conveyance rail 131 and is provided to reciprocate from the feed start position to the midway position. The following pusher 133 is provided at the upper face side of the conveyance rail 131 and carries on, at the midway position, the pushing and conveying operation of the same side handed over from the main pusher 132.

In order to appropriately perform the linear travel of the main pusher 132 and the following pusher 133, i.e., in order to appropriately feed the large sheet 100, guide grooves 134 and 135 are provided to guide the main pusher 132 and the following pusher 133 into the conveyance rail 131. Thus, the depression ends of the main pusher 132 and the following pusher 133 are allowed to fit the guide grooves 134 and 135 so that the depression ends can linearly travel while being regulated by the guide grooves 134 and 135.

As shown, the conveyance from the counting machine 12 to the first conveyance machine 13 also may be performed by providing a carry-in pusher 137 to be handed over to the main pusher 132.

The main pusher 132 is allowed to upwardly rotate at the feed start position by an up-and-down operation mechanism and is opposed to the left side of the large sheet 100 to maintain this state until the primary feeding is completed. Then, the main pusher 132 is downwardly rotated at the midway position and is moved away from the left side of the large sheet 100 and returns to the feed start position.

On the other hand, the base ends of a pair of the following pushers 133 are mutually connected by an axis 136 and are allowed to be downwardly rotated at the midway position by the up-and-down operation mechanism. Then, the base ends are opposed to the left side 104 of the large sheet 100 and maintain this state until the secondary feeding is completed. Furthermore, the following pusher 133 is upwardly rotated at a position at which the secondary feeding is ended and returns to the midway position.

It is noted that the configuration of the first pusher 130 can be arbitrarily changed. Thus, a configuration may not include the carry-in pusher 137, the main pusher 132, or the following pusher 133 as described above. A configuration entirely constituted by a single pusher means or by a combination of such means also may be used. It is important that in any case, the reference side is pushed and conveyed.

(b) Right Side Cutting Step S4

Figure 6:
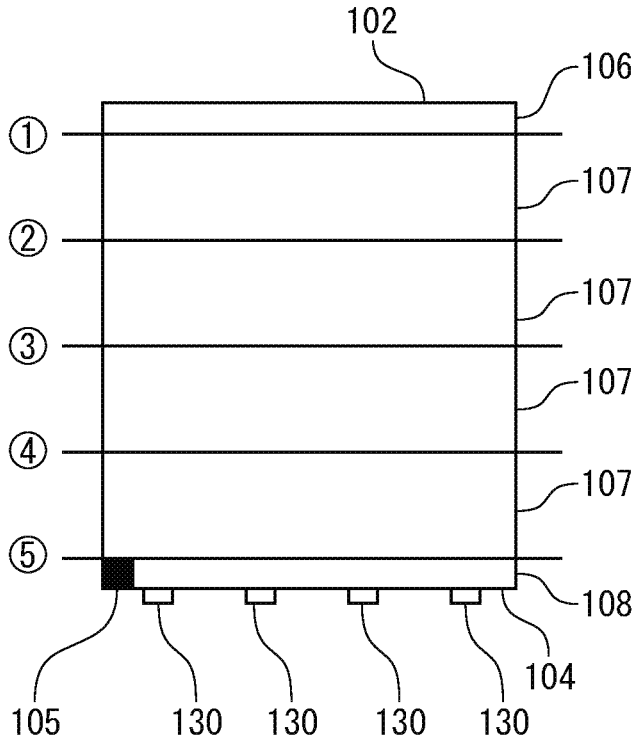
FIG. 6 is an illustration diagram illustrating the cutting method of a column unit block according to the first illustrative embodiment of the present invention.

Next, after the first push step S3, the second cutting machine 14 cuts the right side 102 of the large sheet block 100. FIG. 6 is an illustration diagram illustrating the right side cutting step S4 and the column unit division step S6.

As described above, the right side 102 has not-aligned ends. So, the remaining portion 106 is cut at the line shown by the circled number 1 of FIG. 6. The second cutting machine 14 cuts the large sheet block 100 forwardly traveled by the first pusher 130 while moving the cutting blade 140 in the up-and-down direction.

(c) Right Side Removal Step S5

The right side removal means removes the remaining portion 106 after the right side cutting. The remaining portion 106 is an elongated paper bundle having the length of the entire width of the large sheet 100. Thus, the right side removal means has a structure to remove this immediately behind cutting blade 140. For example, the conveyance rail 131 partially includes an elongated opening and this opening is opened and closed by a butterfly mechanism. Specifically, the butterfly mechanism is provided that is opened upwardly or downwardly only when the remaining portion is downwardly dropped and that is normally horizontally closed, providing a configuration to control the opening and closing in accordance with the pushing and conveyance by the first pusher 130.

(d) Column Unit Division Step S6

The second cutting machine 14 sequentially cuts the right end of the large sheet block 100 while interacting with the pushing and conveyance by the first pusher 130 to divide the block into the long column unit blocks 107 in the up-and-down direction. As described above, in this illustrative embodiment, the main pusher 132 and the following pusher 133 alternately operate to feed the large sheet 100 into the second cutting machine 14 so that cutting is performed. FIG. 6 illustrates how the cutting operations shown by the circled numbers 2 to 5 are performed to provide the division into four column unit blocks 107.

The respective column unit blocks 107 are cut at parallel lines having an equal distance from the reference side 104 and thus can highly accurately have a strip-like shape having an equal width in the left-and-right direction.

(e) Column Unit Block Conveyance Step S8

The column unit block conveyance means conveys the column unit blocks in the right side direction while maintaining a predetermined interval thereamong.

The column unit block 107 is taken out by a gripper 141 provided at the outlet side of the second cutting machine 14 and is conveyed to the next step by a column unit block conveyance pusher 142 reciprocating on the column unit block conveyance rail 143 with a predetermined interval.

Since the cutting of the column unit blocks is completed and the accuracy in the left-and-right direction as high as that required prior to the cutting operation is not required any more, the column unit block conveyance pusher 142 is not always limited to a configuration to push and convey the left side. Another configuration may be used for a pusher in which the block is pushed and conveyed by the lower rotation as in the following pusher 133.

The column unit block conveyance pusher also may have a common mechanism with a part or the entirety of the first pusher 130.

(e-2) Left Side Removal Step S7

In the above column unit division step S6, after the final cutting as shown by the circled number 5 of FIG. 6, the left side remaining portion 108 is caused. Thus, a step may be provided to allow the left side removal means to remove the remaining portion 108 after the final cutting.

The left side remaining portion 108 is also an elongated paper bundle having the length of the entire width of the large sheet 100. Thus, as in the right side removal means, this may be removed immediately behind the cutting blade 140. A butterfly mechanism is provided that is opened upwardly or downwardly only when the remaining portion 108 is downwardly dropped and that is normally horizontally closed, providing a configuration to control the opening and closing in accordance with the pushing and conveyance by the first pusher 130.

(f) Second Push Step S9

After the column unit block 107 is conveyed by the column unit block conveyance pusher 142, the second pusher 150 pushes and conveys the upper side 101*a* of the column unit block 107 toward the lower side direction. The second pusher 150 changes the conveyance direction by 90 degrees and pushes the upper side 101*a* as the reference side of the column unit block 107. An effect to suppress the sheet displacement by pushing the reference side is provided as described above.

The second pusher 150 has a similar structure to that of the first pusher 130. The conveyance operation until the fourth cutting machine 16 is reached is performed by the same pusher or the operation is carried on at the midway position by another pusher.

(g) Lower Side Cutting Step S10

Figure 7:
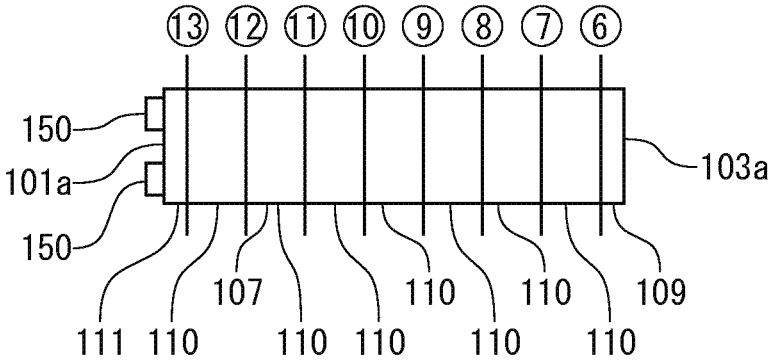
FIG. 7 is an illustration diagram illustrating the cutting method of a small block according to the first illustrative embodiment of the present invention.

Next, after the second push step S9, the fourth cutting machine 16 cuts the lower side 103*a* of the column unit block 107. FIG. 7 is an illustration diagram illustrating the lower side cutting step S10 and the small block division step S12.

The lower side 103*a* is a part of the lower side 103 and thus has not-aligned ends as described above. Thus, the remaining portion 109 is cut at the line shown by the circled number 6 of FIG. 7. The fourth cutting machine 16 cuts the column unit block 107 forwardly traveled by the first pusher 150 while moving the cutting blade in the up-and-down direction.

(h) Lower Side Removal Step S11

The lower side removal means removes the remaining portion 109 after the lower side cutting. The lower side removal means has a similar structure to the right side removal means to remove this immediately behind the cutting blade of the fourth cutting machine 16. A butterfly mechanism is provided that is opened upwardly or downwardly only when the remaining portion 109 is downwardly dropped and that is normally horizontally closed, providing a configuration to control the opening and closing in accordance with the pushing and conveyance by the second pusher 150.

(i) Small Block Division Step S12

The fourth cutting machine 16 sequentially cuts the lower ends of the column unit block 107 while interacting with the pushing and conveyance by the second pusher 150 to divide the block into small blocks 110. FIG. 7 illustrates how the cutting operations of the circled numbers 7 to 13 are performed to divide the block into seven small blocks 110.

The respective small blocks 110 are cut at parallel lines having an equal distance from the reference side 101*a* and thus can accurately provide final products having an equal width in the up-and-down direction.

(i-2) Upper Side Removal Step S13

In the above small block division step S12, an upper side remaining portion 111 is caused after the final cutting as shown in the circled number 13 of FIG. 7. Thus, a step may be provided in which the upper side removal means removes the remaining portion 111 after the final cutting operation.

The upper side remaining portion 111, as in common with the lower side removal means, may also remove this immediately behind the cutting blade. A butterfly mechanism is provided that is opened upwardly or downwardly only when the remaining portion 111 is downwardly dropped and that is normally horizontally closed, providing a configuration to control the opening and closing in accordance with the pushing and conveyance by the second pusher 150.

According to the present invention, the processings to the small block division step S12 are performed and the subsequent processings may be arbitrarily performed. In this illustrative embodiment, the following steps are further performed.

(j) Small Block Conveyance Step S14

The discharge machine 17 conveys the divided small blocks in the lower side direction while maintaining a predetermined interval thereamong and then the blocks are taken out from the cutting apparatus 10. Although not shown, the small block 110 is taken by a gripper provided at the outlet side of the fourth cutting machine 16 and is conveyed to the next step by a small block conveyance pusher reciprocating with a predetermined interval.

(k) Strapping Step S15

The small blocks 110 of each block are taken out and are strapped by a not-shown strapping machine. The strapping machine may be appropriately selected from among known machines.

Conventionally, an example has been found in which the center position of the small block is firstly strapped in the column unit block 107. However, this conventional example had a problem in that deflection is easily caused, thus causing a lowered cutting accuracy. According to the present invention, divided small blocks are strapped, thereby realizing a cutting method by which all cutting steps are suppressed from causing an error.

In this illustrative embodiment, the front and back sides of the large sheet block 100 are inverted to set an upper side and a left side as the reference side and the block is subsequently set in the cutting apparatus 10. In this case, strapped small blocks are preferably inverted again by a not-shown inversion apparatus to return to the original direction. This second inversion step is important when a plurality of small blocks are arranged in an order of the numbers for example.

(Second Illustrative Embodiment)

Figure 8:
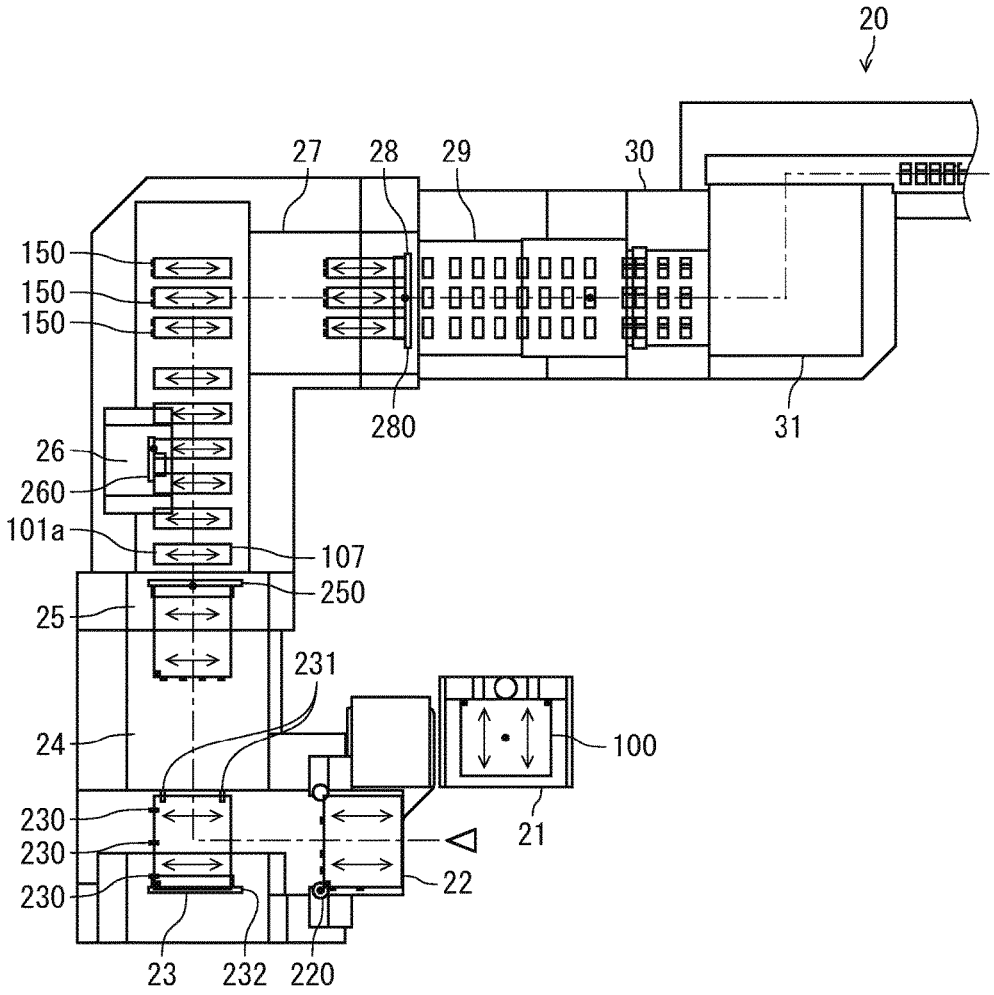
FIG. 8 is an illustration diagram illustrating the entirety of the cutting apparatus according to the second illustrative embodiment of the present invention.

FIG. 8 is an illustration diagram illustrating the entirety of a cutting apparatus 20 according to the second illustrative embodiment of the present invention.

The cutting apparatus 20 has, in an order of the steps, a jogging machine 21, the counting machine 22, the first cutting machine 23, the first conveyance machine 24, the second cutting machine 25, the third cutting machine 26, the second conveyance machine 27, the fourth cutting machine 28, and a discharge machine 29 for the large sheet 100.

Small blocks taken out from the discharge machine 29 are further processed by a strapping apparatus 30 and an alignment apparatus 31.

Regarding the description of the second illustrative embodiment, steps similar to those of the first illustrative embodiment will not be further described. Thus, main differences therebetween will be described below. In this illustrative embodiment, a basic reference side in the jogging machine 21 is determined. During this, depending on the paper grain direction of the large sheet block 100, the sheet is oriented so that the paper grain direction is parallel to the right side and the left side.

Then, as shown in FIG. 2, when the large sheet 100 is seen from above, the respective sides are assumed as the upper side 101, the right side 102, the lower side 103, and the left side 104, respectively. As shown in FIG. 2(*a*), the jogging machine 21 jogs the upper side 101 and the left side 104 as a reference side. In this illustrative embodiment, the upper side 101 and the right side 102 also can be set as a reference side.

In the jogging machine 21, the jogged large sheet blocks 100 are gripped by the gripper and are counted by the counting machine 22. The counting machine 22 includes a counter 220. Subsequently, the processing proceeds to the cutting processing of the present invention.

Figure 9:
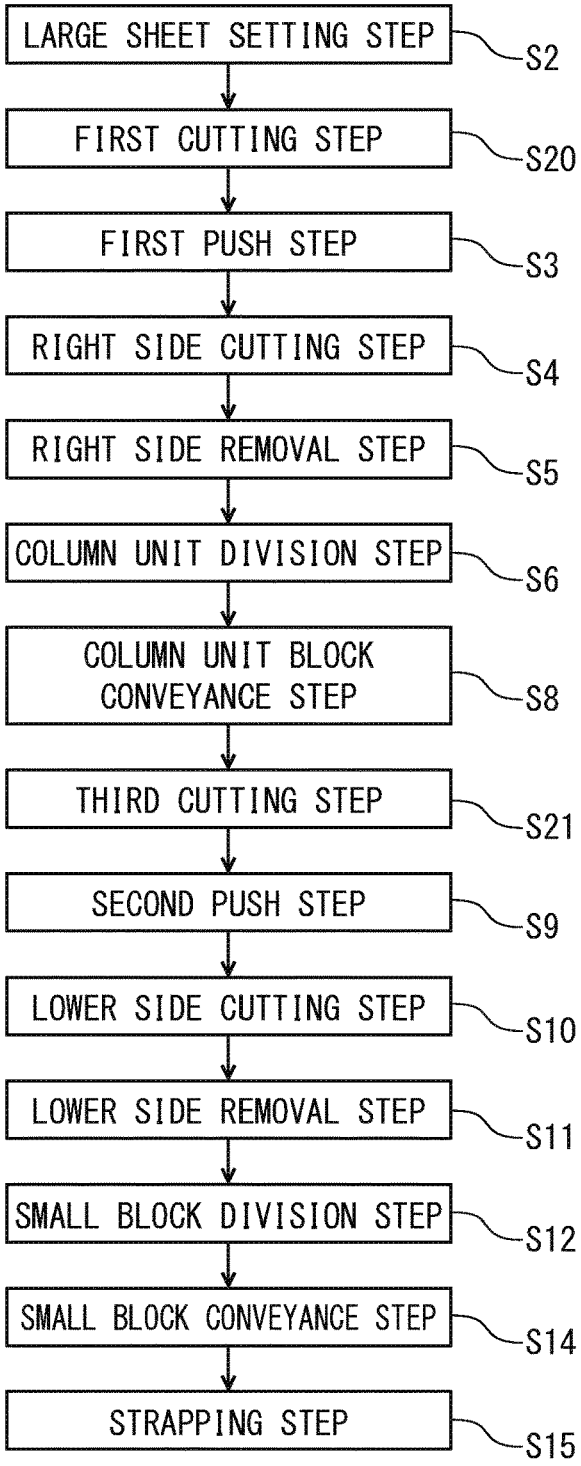
FIG. 9 is a flowchart illustrating the cutting method according to the second illustrative embodiment of the present invention.

FIG. 9 is a flowchart illustrating the cutting method according to the second illustrative embodiment.

(A) First Cutting Step S20

Figure 10:
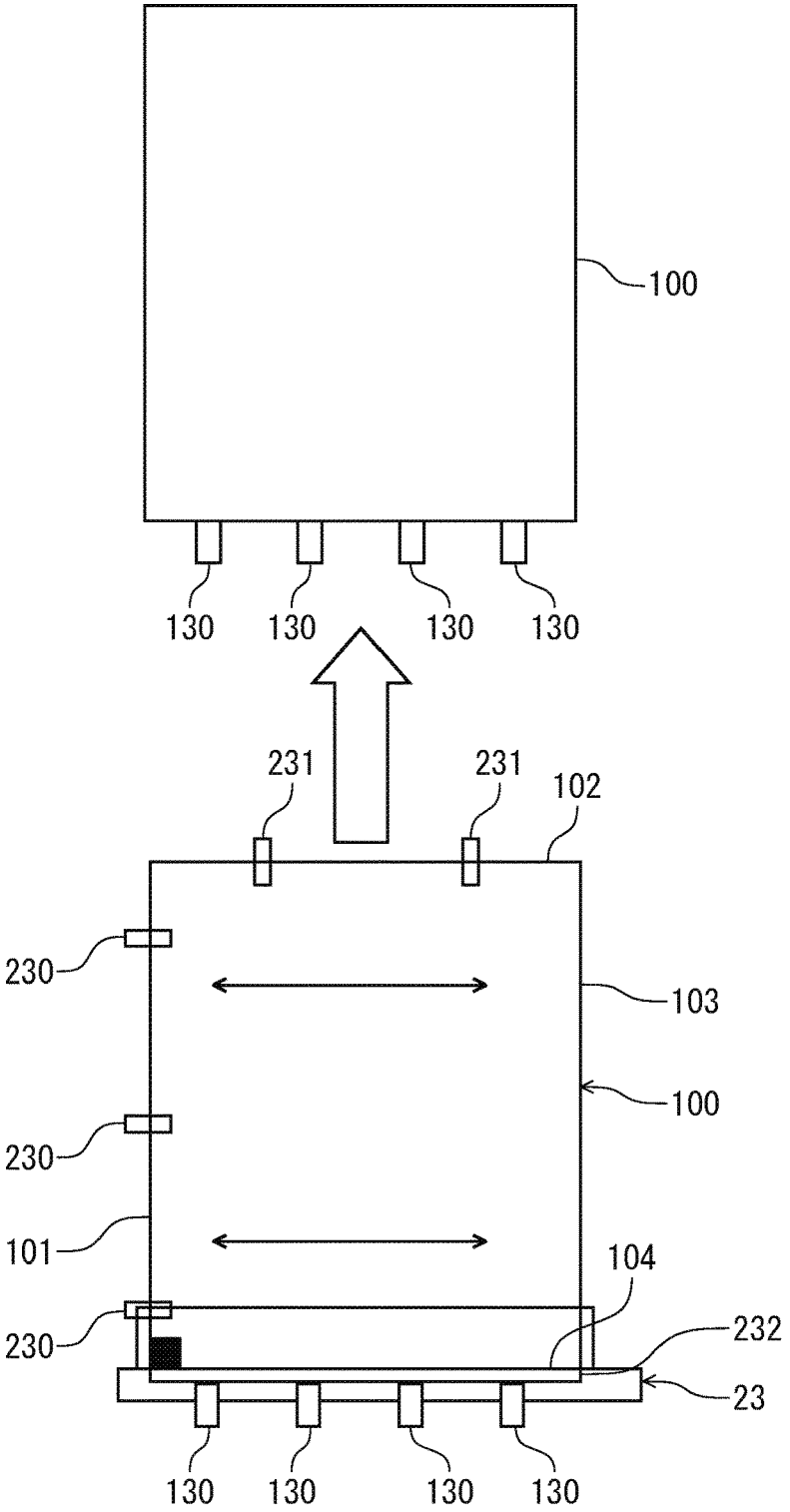
FIG. 10 is an illustration diagram illustrating the first cutting step and the first push step.

The first cutting machine 23 cuts the left side 104 of the large sheet block 100. FIG. 10 is an illustration diagram illustrating the first cutting step S20. First, the cutting blade 232 is used to cut the left side 104 while allowing grippers 230 and 231 to grip the upper side and the right side.

The left sides 104 of the respective sheets are aligned with very high accuracy by the cutting operation. Thus, this cut face is used as a reference side.

The remaining portion at the cut left side can be removed by being directly dropped.

(B) First Push Step S3

The first conveyance machine 24 pushes and conveys the left side 104 of the cut large sheet block toward the right side direction. The first conveyance machine 24 includes four first pushers 130 for example to push and convey the left side 104.

(C) Right Side Cutting Step S4

Figure 11:
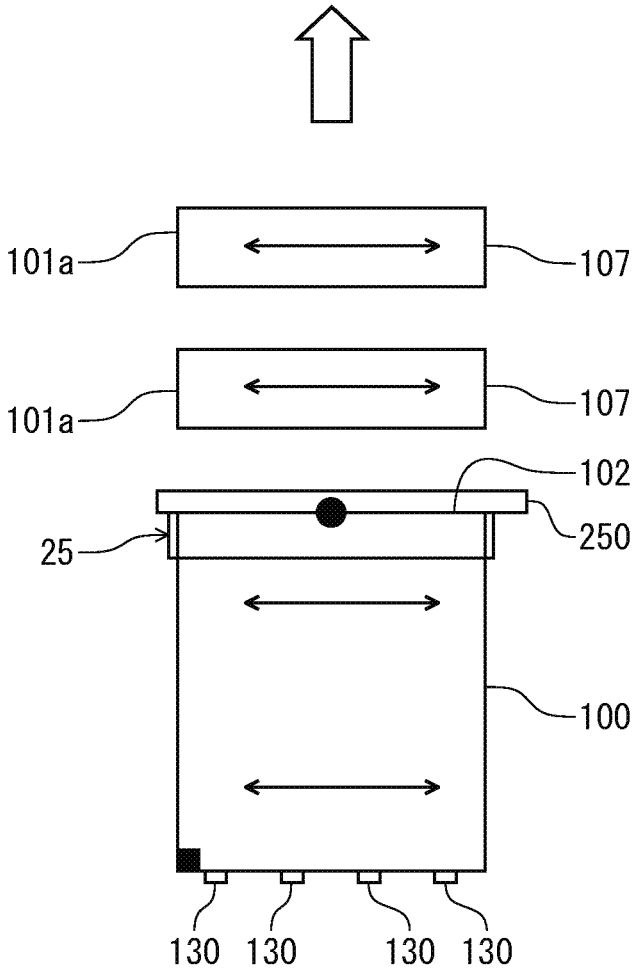
FIG. 11 is an illustration diagram illustrating a right side cutting step and a column unit division step.

After the first push step S3, the second cutting machine 25 cuts the right side 102 of the large sheet block 100. FIG. 11 is an illustration diagram illustrating the right side cutting step S4. As described above, the right side 102 has not-aligned ends. So, the second cutting machine 25 has the cutting blade 250 to cut the remaining portion of the right side 102.

(D) Right Side Removal Step S5

The right side removal means removes the remaining portion after the right side cutting.

(E) Column Unit Division Step S6

The second cutting machine 25 sequentially cuts the right end of the large sheet block 100 while interacting with the pushing and conveyance by the first pusher 130 to divide the block into the long column unit blocks 107 in the up-and-down direction.

(F) Column Unit Block Conveyance Step S8

The column unit block conveyance means conveys the column unit blocks in the right side direction while maintaining a predetermined interval thereamong.

(G) Third Cutting Step S21

The third cutting machine 26 cuts each upper side 101*a* of the column unit block 107. While allowing the block to be conveyed by a pusher like the column unit block conveyance pusher 142 of the column unit block conveyance means, the cutting blade 260 of the third cutting machine 26 sequentially cuts the upper side 101*a* to provide reference sides aligned with a high accuracy. The remaining portion at the cut upper side can be removed by being directly dropped.

(H) Second Push Step S9

After the column unit block 107 is conveyed by the column unit block conveyance pusher 142 for example, the second pusher 150 pushes and conveys the upper side 101*a* of the column unit block 107 toward the lower side direction. The second pusher 150 changes the conveyance direction by 90 degrees to push the upper side 101*a* as a reference side of the column unit block 107. The sheet displacement is minimized by pushing the reference side obtained through the third cutting step S21.

(I) Lower Side Cutting Step S10

Figure 12:
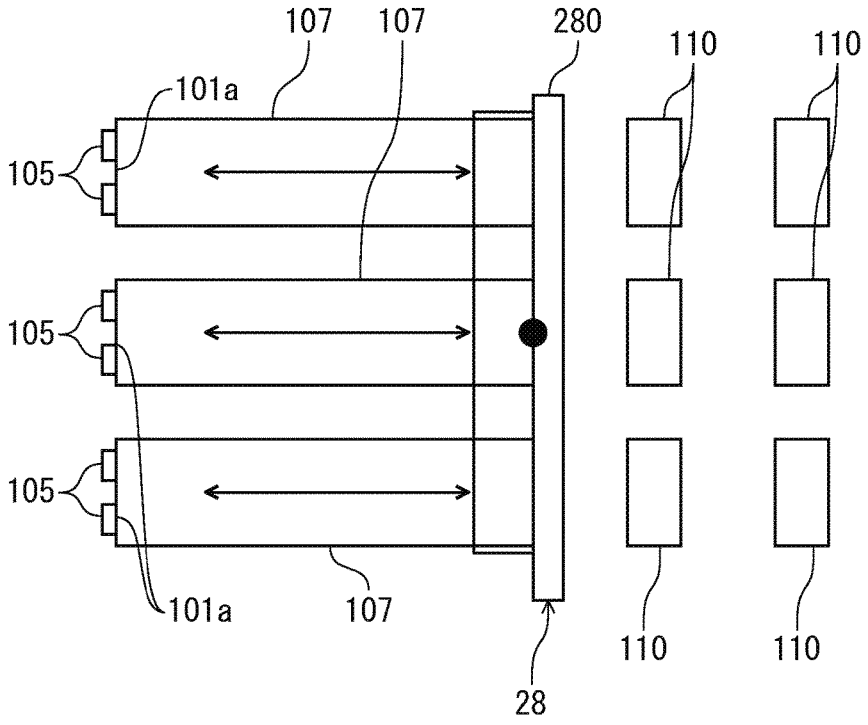
FIG. 12 is an illustration diagram illustrating a lower side cutting step and a small block division step.

Next, after the second push step S9, the fourth cutting machine 28 cuts the lower side 103*a* of the column unit block 107. FIG. 12 is an illustration diagram illustrating the lower side cutting step S10 and the small block division step S12.

Since the lower side 103*a* is a part of the lower side 103, the lower side 103*a* has not-aligned ends as described above. So, a remaining portion is cut. The fourth cutting machine 28 cuts the column unit block 107 forwardly traveled by the first pusher 150 while moving the cutting blade 280 in the up-and-down direction.

(J) Lower Side Removal Step S11

The lower side removal means removes the remaining portion after the lower side cutting.

(K) Small Block Division Step S12

The fourth cutting machine 28 sequentially cuts the lower end of column unit block 107 while interacting with the pushing and conveyance by the second pusher 150 to divide the block into the small blocks 110. The respective small blocks 110 are cut at parallel lines having an equal distance from the reference side 101*a* and thus can highly accurately provide final products having an equal width in the up-and-down direction.

According to the present invention, the processings to the small block division step S12 are performed and the subsequent processings may be arbitrarily performed. In this illustrative embodiment, the following steps are further performed.

(L) Small Block Conveyance Step S14

The discharge machine 29 conveys the divided small blocks in the lower side direction while maintaining a predetermined interval thereamong and the blocks are taken out from the cutting apparatus 20. Although not shown, the small block 110 is taken out by a gripper provided at the outlet side of the fourth cutting machine 28 and is conveyed to the next step by a small block conveyance pusher reciprocating with a predetermined interval.

(M) Strapping Step S15

The small blocks 110 of each block are taken out and are strapped by a not-shown strapping machine. The strapping machine may be appropriately selected from among known machines.

The small blocks 110 subjected to the strapping processing also can be aligned by the alignment apparatus 31. The alignment apparatus 31 has a known configuration and can extract small blocks by a desired order to align the blocks.

The present invention has a configuration as described above. The following section will describe an action of the present invention.

Figure 13:
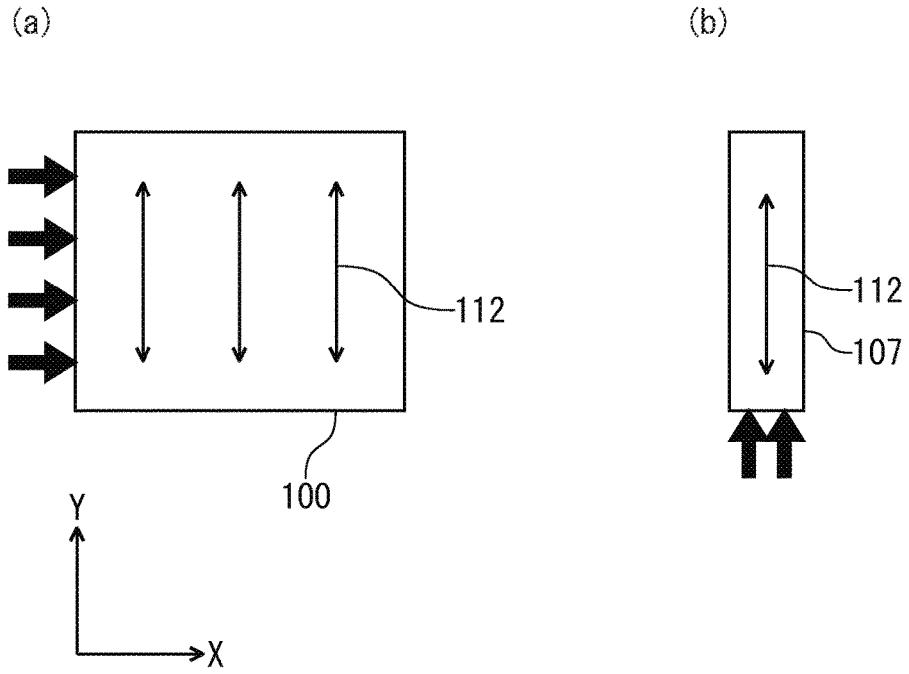
FIG. 13 is an illustration diagram illustrating the relation between the paper grain direction and the push direction.

FIG. 13 is an illustration diagram illustrating the relation between the paper grain direction and the push direction. As is well-known, paper has a paper grain direction (paper orientation profile) due to the pulp orientation direction of a paper machine in a paper making step. When paper is pushed and conveyed by a pusher, the paper is suppressed from being bent in a direction parallel to the paper grain direction 112 (direction Y), thus suppressing errors. Paper in a direction orthogonal to the paper grain direction 112 (direction X) on the other hand is easily bent, thus tending to cause errors.

To solve this, according to the present invention, prior to the cutting of the large sheet 100, when the entire width of the sheet is use to be pushed and conveyed by the first pusher 130, the sheet is conveyed in the direction X, and when the narrow side of the column unit block 107 is pushed and conveyed by the second pusher 150, the sheet is conveyed in the direction Y. Thus, it is important that a direction parallel to the right side and the left side conforms to the paper grain direction and that the left side is pushed and conveyed in the right side direction (or similarly in an opposite direction) in the first push step.

At the same time, the rotation of the large sheet 100 as in the conventional case causes an error. Thus, it is also important that the sheet is divided into column unit blocks and then the upper sides of the column unit blocks are pushed and conveyed toward the lower side direction without changing a direction.

Therefore, by appropriately combining them, the present invention realizes an accurate cutting processing.

Figure 14:
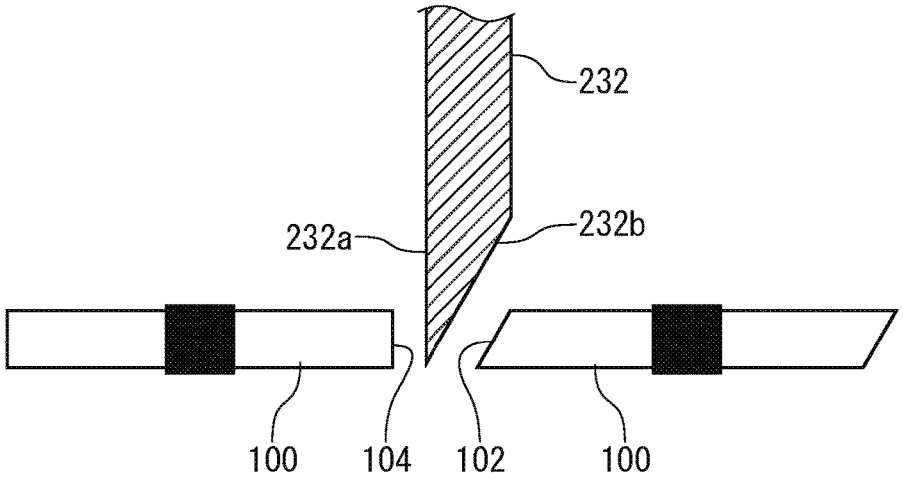
FIG. 14 is an illustration diagram illustrating the direction of a blade edge in the cutting means of the present invention.

FIG. 14 illustrates the direction of the blade edge of the cutting blade. In the cutting blade 232 of the first cutting machine 23, the cutting blade 232 is a single edge-shaped blade edge of which one side is substantially vertical (232*a*)

and one side has an inclined blade ridge (232*b*). A side pushed and conveyed by the first pusher 130, i.e., the left side 104, is cut by a substantially vertical-side blade edge.

As can be seen from the drawing, when the sheet is cut by the blade ridge (232*b*) side, the cut face is slightly inclined. Thus, according to the present invention, the cutting blade is provided so that the reference side is an accurate end face.

This also applies to the third cutting machine 26. Thus, the cutting blade 260 is configured so that the vertical blade side faces the upper side 101*a* side of the column unit block 107 so that the sheet can be accurately pushed and conveyed by the second pusher 150.

Figure 15:
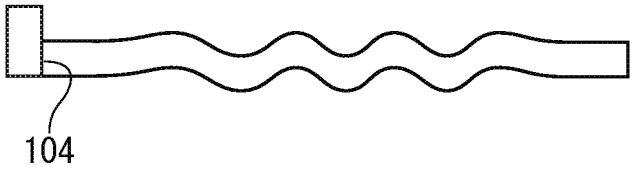
FIG. 15 illustrates the effect of the cutting method in the present invention.
Figure 15:
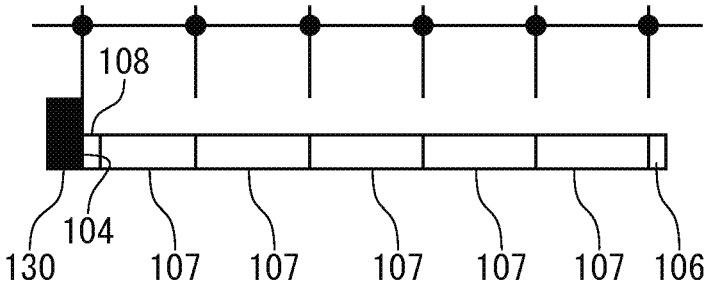

FIG. 15 illustrates the effect of the cutting method in the present invention. FIG. 15(*a*) illustrates the state of the sheet cross section when the conventional technique is used to simultaneously cut both sides of the large sheet 100 or the column unit block 107. A sheet whose surface is printed has a significant distortion of paper due to time passage, ink, or the conveyance during printing, causing an error in the sheet length. If this error is not considered and both sides are simultaneously cut and the block is sequentially divided into the column unit blocks 107 or the small blocks 110, a finally-obtained block may deviate from a specified size with a high probability.

According to the present invention, as shown in FIG. 15(*b*), the remaining portion 106, the column unit block 107, and the remaining portion 108 are cut on site while allowing the reference side 104 to be pushed and conveyed by the first pusher 130. Thus, each block is suppressed from having an error and a finally-obtained block also can be cut with the same accuracy at which other blocks are cut.

According to the present invention, the above illustrative embodiment has been described as the one having a configuration in which an upper side and a left side are set as a reference side. However, it is clear that totally the same effect can be obtained in claims and the illustrative embodiment by a symmetric configuration in the left-and-right direction. Thus, by substituting all left sides with right sides and substituting left ends with right ends, the respective drawings of the illustrative embodiment can be performed as a symmetric drawing.

REFERENCE SIGNS LIST

10 Cutting apparatus
11 Jogging machine
12 Counting machine
13 First conveyance machine
14 Second cutting machine
15 Second conveyance machine
16 Fourth cutting machine
17 Discharge machine
100 Large sheet
101 Upper side
101*a* Upper side
102 Right side
103 Lower side
103*a* Lower side
104 Left side
105 Reference angle
107 Column unit block
108 Portion
109 Portion
110 Small block
120 Counter
130 First pusher
140 Cutting blade
141 Gripper
142 Column unit block conveyance pusher
150 Second pusher

What is claimed is:

1. A cutting method by which a first sheet block obtained by stacking a plurality of first sheets is cut by a cutting means to divide the sheet into second blocks, which are smaller than said first sheet block, wherein the respective sides when each of the first sheets is seen from above are assumed as an upper side, a right side, a lower side, and a left side, respectively, and two adjacent reference sides that have been jogged are assumed as an upper side and a left side and are placed in the cutting apparatus, and the method has the following steps:

a first cutting step of cutting the left side of the first sheet block so that a direction parallel to the left side conforms to the paper grain direction;

a first push step to allow the first pusher to immediately push and convey the left side of the cut first sheet block toward the right side direction;

a right side cutting step to allow, after the first push step, the second cutting means to cut the right side of the first sheet block;

a right side removal step to allow the right side removal means to remove the remaining portion after the right side cutting;

a column unit division step to allow the second cutting means to sequentially cut, while interacting with the pushing and conveyance by the first pusher, the right side of the first sheet block to divide the block into long column unit blocks in the up-and-down direction;

a column unit block conveyance step to allow the column unit block conveyance means to convey the column unit blocks in the right side direction while maintaining a predetermined interval thereamong;

a third cutting step to allow the third cutting means to cut the each upper side of the column unit block;

a second push step to allow the second pusher to push and convey the cut upper side of the column unit block in the lower side direction;

a lower side cutting step to allow the fourth cutting means to cut the lower side of the column unit block after the second push step;

a lower side removal step to allow a lower side removal means to remove a remaining portion after the lower side cutting; and a small block division step to allow the fourth cutting means to sequentially cut, while interacting with the pushing and conveyance by the second pusher, the lower side of the column unit block to divide the first block into second blocks.

2. The cutting method according to claim 1, wherein the second cutting means cuts the left side of a final column unit block sequentially cut out of the first sheet block and further has, after the column unit division step, a left side removal step to allow the left side removal means to remove a remaining portion after the left side cutting.

3. The cutting method according to claim 1, wherein the fourth cutting means cuts the upper side of the final second block sequentially cut out of the column unit block and further has, after the small block division step, an upper side removal step to allow the upper side removal means to remove a remaining portion after the upper side cutting.

4. The cutting method according to claim 1, wherein a single edge-shaped blade edge of which one side is substantially vertical and the other side has an inclined blade ridge is used as the cutting means; and a side pushed and conveyed by the pusher in each push step can be cut by a substantially vertical-side blade edge.

5. The cutting method according to claim 1, further comprising a small block conveyance step to convey, after the small block division step, the second blocks in the right side direction while maintaining a predetermined interval thereamong and a strapping step to strap the respective second blocks.

6. The cutting method according to claim 1, wherein the right side and the left side of the first sheet block and the left side and the left end of the first sheet block are mutually exchanged in the above description to provide a symmetrical configuration.

7. A cutting apparatus by which a first sheet block obtained by stacking a plurality of first sheets is cut by a cutting means to divide the first sheet block into second blocks, which are smaller than said first sheet blocks, wherein the respective sides when each of the first sheets is seen from above are assumed as an upper side, a right side, a lower side, and a left side, respectively, and the cutting apparatus comprises:

a first cutting means for cutting the left side of the first sheet block so that a direction parallel to the left side conforms to the paper grain direction;

a first pusher for immediately pushing and conveying the left side of the cut first sheet block toward the right side direction;

a second cutting means for cutting the right side of the first sheet block pushed and conveyed by the first pusher and sequentially cutting the right end of the first sheet block while interacting with the pushing and conveyance by the first pusher to divide the first sheet block into long column unit blocks in the up-and-down direction;

a right side removal means for removing the remaining portion after the right side cutting by the second cutting means, a column unit block conveyance means for conveying the column unit blocks in the right side direction while maintaining a predetermined interval thereamong;

a third cutting means for cutting each upper side of the column unit block;

a second pusher for pushing and conveying the upper sides of the cut column unit blocks in the lower side direction;

a fourth cutting means for cutting the lower side of the column unit block pushed and conveyed by the second pusher and that sequentially cuts the lower side of the column unit block while interacting with the pushing and conveyance by the second pusher to divide the block into second blocks; and a lower side removal means for removing the remaining portion after the lower side cutting by the fourth cutting means.

8. The cutting apparatus according to claim 7, wherein the second cutting means cuts the left side of a final column unit block sequentially cut out of the first sheet block and comprises a left side removal means for removing a remaining portion after the side cutting.

9. The cutting apparatus according to claim 7, wherein the fourth cutting means cuts the upper side of a final small column unit block sequentially cut out of the first sheet block and comprises an upper side removal means for removing a remaining portion after the upper side cutting.

10. The cutting apparatus according to claim 7, wherein the first cutting means and the second cutting means use a single edge-shaped blade edge of which one side is substantially vertical and the other side has an inclined blade ridge, the blade edge of the first cutting means is placed so that the left side of a cut first sheet block faces the substantially vertical side, and the blade edge of the second cutting means is placed so that the left side of a cut column unit block faces the blade ridge.

11. The cutting apparatus according to claim 7, wherein the third cutting means uses a single edge-shaped blade edge of which one side is substantially vertical and the other side has an inclined blade ridge, and the blade edge of the third cutting means is placed so that the upper side of a cut column unit block faces the substantially vertical side.

12. The cutting apparatus according to claim 7, wherein at least one of the first pusher or the second pusher includes a main pusher performing the pushing and conveyance from a feed start position to a midway position and a following pusher taking over the operation at a midway position from the main pusher to push and convey the same side and is placed so that one pusher returns to a feed start position while the other pusher is performing an intermittent feeding so as to be able to immediately start the next intermittent feeding.

13. The cutting apparatus according to claim 7, including:

a small block conveyance means for conveying the second blocks divided by the fourth cutting means in the right side direction while maintaining a predetermined interval thereamong; and a strapping means for strapping the respective second blocks.

14. The cutting apparatus according to claim 7, wherein the right side removal means includes a butterfly mechanism that releases, immediately behind in the conveyance direction of the second cutting means, the remaining portion after the right side cutting in the upper or lower direction only when the remaining portion is dropped and that is normally horizontally closed, providing a configuration to control the opening and closing in accordance with the pushing and conveyance by the first pusher.

15. The cutting apparatus according to claim 7, wherein the lower side removal means includes a butterfly mechanism that releases, immediately behind in the conveyance direction of the fourth cutting means, the remaining portion after the lower side cutting in the upper or lower direction only when the remaining portion is dropped and that is normally horizontally closed, providing a configuration to control the opening and closing in accordance with the pushing and conveyance by the second pusher.

16. The cutting apparatus according to claim 7, wherein the right side and the left side of the first sheet block are mutually exchanged to provide a symmetrical configuration.

* * * * *